United States Patent [19]

Tsurubuchi

[11] 4,208,940

[45] Jun. 24, 1980

[54] DEVICE FOR PRODUCING AN ENSEMBLE EFFECT

[75] Inventor: Tooru Tsurubuchi, Osaka, Japan

[73] Assignee: Roland Corporation, Osaka, Japan

[21] Appl. No.: 855,343

[22] Filed: Nov. 28, 1977

Related U.S. Application Data

[63] Continuation of Ser. No. 664,355, Mar. 5, 1976, abandoned.

[30] Foreign Application Priority Data

Mar. 19, 1975 [JP] Japan ..... 50-33689

[51] Int. Cl.[2] ..... G10H 1/02

[52] U.S. Cl. ..... 84/1.24; 84/DIG. 4

[58] Field of Search ..... 84/1.01, 1.24, 1.25, 84/DIG. 4

[56] References Cited

U.S. PATENT DOCUMENTS

| | | | |
|---|---|---|---|
| 3,007,361 | 11/1961 | Wayne, Jr. | 84/1.01 |
| 3,263,019 | 7/1966 | Hurvitz | 84/1.24 |
| 3,746,774 | 7/1973 | Adachi | 84/1.22 |
| 3,833,752 | 9/1924 | van der Kooij | 84/1.24 |
| 3,866,505 | 2/1975 | Adachi | 84/1.24 |

*Primary Examiner*—Vit W. Miska

*Attorney, Agent, or Firm*—Wenderoth, Lind & Ponack

[57] ABSTRACT

A device for producing an ensemble effect in an electronic musical instrument. The device has a plurality of parallel electronic delay circuits adapted to be supplied with a musical tone signal, delay time modulating circuits coupled to each of said delay circuits for modulating the delay time in each delay circuit, a modulating signal generating circuit arrangement coupled to the delay time modulating circuits for supplying modulating signals to the respective delay time modulating circuits which are different from each other and the frequencies of which are in an integral multiple relationship to each other. Amplifiers are coupled to each of the delay circuits for amplifying the output thereof, and the amplifier outputs are mixed either electronically or acoustically.

6 Claims, 17 Drawing Figures

FIG.2
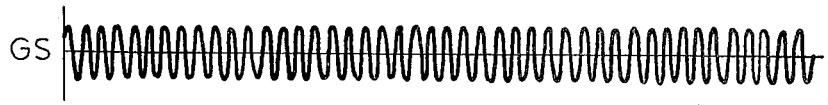
FIG.3 (a-1)
FIG.3 (a-2)
FIG.3 (a-3)
FIG.3 (b-1)
FIG.3 (b-2)
FIG.3 (b-3)
FIG.3 (c-1)
FIG.3 (c-2)
FIG.3 (c-3)
FIG.3 (d-1)
FIG.3 (d-2)
FIG.3 (d-3)
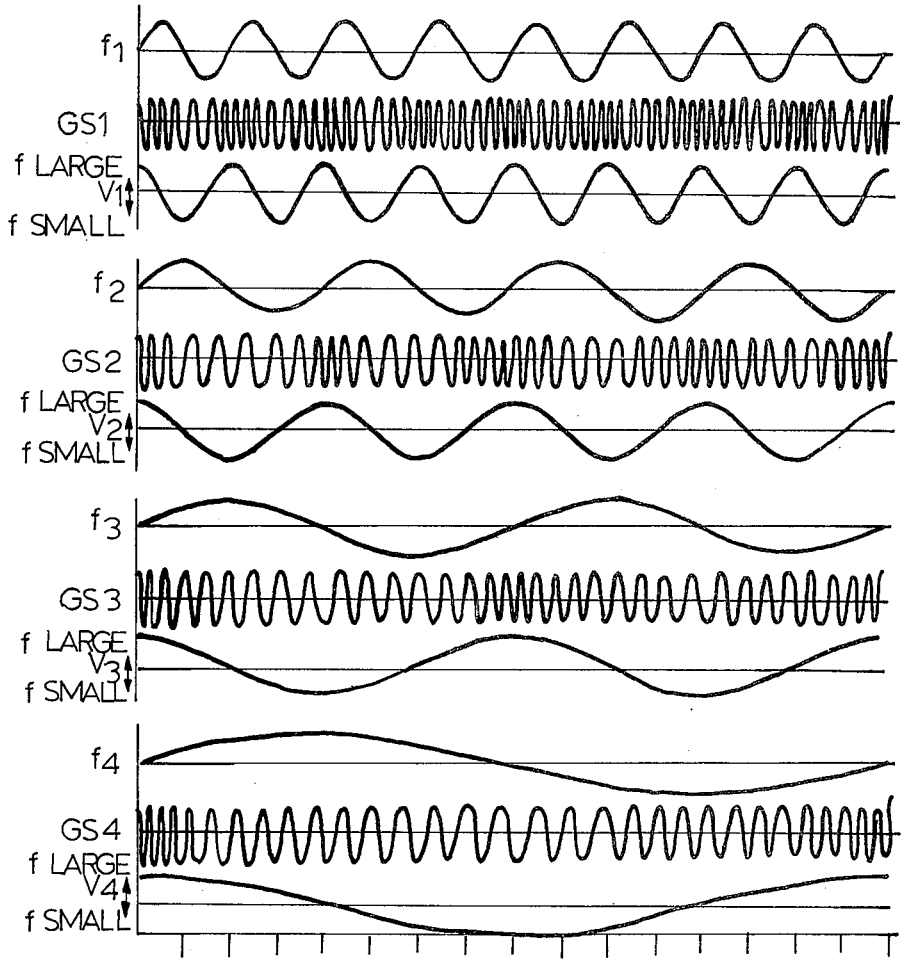

DEVICE FOR PRODUCING AN ENSEMBLE EFFECT

This is a continuation of application Ser. No. 664,355, filed Mar. 5, 1976 now abandoned.

This invention relates to a device for producing an ensemble effect in an electronic musical instrument.

BACKGROUND OF THE INVENTION AND PRIOR ART

There is already known a device for tempering a musical signal with an ensemble effect, wherein the musical tone signal input is mixed with a further musical signal, the frequency of which is continuously varied upwards and downwards from the frequency of the original musical tone signal, said further musical signal being produced by modulating the delay time of the original musical tone signal by means of a plurality of sinusoidal wave modulating signals, the phases of which differ by a uniform angle. Alternatively, the modulating signals can be such as to produce a double modulation with a frequency as low as about 1/10 of that of the modulating signal. The modulating period corresponds to a low frequency of 0.2–1 c/s. However, because each of the modulated musical tone signals is a signal having a slight vibrato and the phase differences between modulation signals are uniform, the vibrato effects will cancel each other and will make the ensemble effect audible. However, the vibrato effect is not completely eliminated so that an adequate ensemble effect has not yet been achieved.

OBJECT AND BRIEF SUMMARY OF THE INVENTION

It is an object of this invention to provide a device for producing an ensemble effect in which the defects as described above are eliminated and which device will produce a satisfactory ensemble effect.

This object is achieved by a device according to the present invention for producing an ensemble effect in an electronic musical instrument comprising a plurality of parallel electronic delay circuits adapted to be supplied with a musical tone signal, delay time modulating means coupled to each of said delay circuits for modulating the delay time in each delay circuit, modulating signal generating means coupled to said delay time modulating means for supplying modulating signals to the respective delay time modulating means which are different from each other and which are in an integral multiple relationship to each other, amplifier means coupled to each of said delay circuits for amplifying the output thereof, and mixing means coupled to said amplifier means for mixing the amplified outputs.

BRIEF DESCRIPTION OF THE FIGURES

The invention will now be explained in greater detail with reference to the accompanying drawings, in which:

FIG. 2 is a diagram of the waveform of a musical tone signal GS;

FIGS. 3(*a*-1)-3(*d*-3) are waveform diagrams illustrating the output musical tone signals, sinusoidal waveforms for modulation, and various waveforms for depicting the aspects of modulation;

DETAILED DESCRIPTION OF THE INVENTION

A musical tone signal GS (shown in FIG. 2), is generated in musical tone signal source G and supplied to a plurality of parallel connected delay elements 1, 2, 3 and 4 which are constituted by electronic delay circuits such as bucket brigade devices, charge coupled devices, and the like. These delay elements are supplied with modulating signals for modulation of the delay time from corresponding carrier oscillators C1, C2, C3 and C4. The musical tone signal GS will thus be subjected to delay time modulation in each of the delay elements. The modulating signals for delay time modulation are oscillating waves from the corresponding carrier oscillators which in turn have been frequency modulated by sinusoidal waves f1–f4. Sinusoidal waves f1–f4 are produced by means of rectangular wave oscillator Fo which produces a rectangular wave having a frequency f and a flip-flop circuit consisting of a series of frequency dividers D1, D2 and D3 connected to rectangular wave oscillator Fo and producing rectangular waves f/2, f/4 and f/8 which have frequencies in the relation to f of $\frac{1}{2}$, $\frac{1}{4}$, $\frac{1}{8}$ . . . . However, the relationship can be any integral multiple relationship. The respective rectangular waves f, f/2, f/4 and f/8 are passed through filters F1, F2, F3 and F4 connected to the outputs of oscillator $F_o$ and dividers D1-D3, respectively. The frequencies of waves f1–f4 are also in the relation 1, $\frac{1}{2}$n, $\frac{1}{4}$n, $\frac{1}{8}$n and have the waveforms as shown in FIGS. 3(*a*-1), 3(*b*-1), 3(*c*-1) and 3(*d*-1). The output musical tone signals from delay elements GS1, GS2, GS3 and GS4 have the waveforms as shown in FIGS. 3(*a*-2), 3(*b*-2), 3(*c*-2) and 3(*d*-2). The frequencies of these output musical tone signals vary according to the waveforms v1-v4 as shown in FIGS. 3(*a*-3), 3(*b*-3), 3(*c*-3) and 3(*d*-3). The output musical tone signals GS1–GS4 are amplified by the amplifiers A1, A2, A3 and A4 connected to the outputs of delay elements 1–4, respectively, and are electrically mixed and amplified by the mixer amplifier M and acoustically developed by the speaker SP to produce an adequate ensemble effect.

Figure 4:
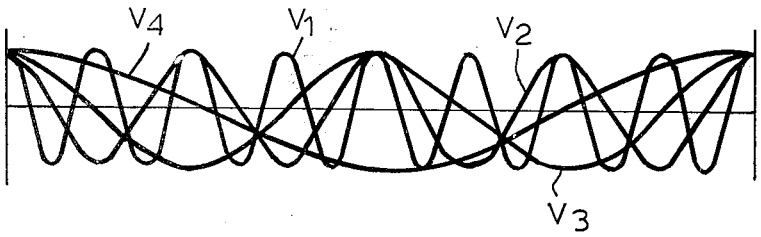
FIG. 4 is a diagram of a set of waveforms for illustrating an ensemble effect according to this invention.

As can be seen from FIG. 4, wherein there is shown the waveforms v1-v4 superimposed, each output musical tone signal is modulated so that the frequency variations are in predetermined successive integral multiple relationships, and as a result, the acoustically reproduced musical tone signals which have been electrically mixed will cause substantially no vibrato effect to be felt because it has been cancelled, even if each of the output musical tone signals GS1, GS2, GS3 and GS4 has an inherent vibrato effect.

Figure 1:
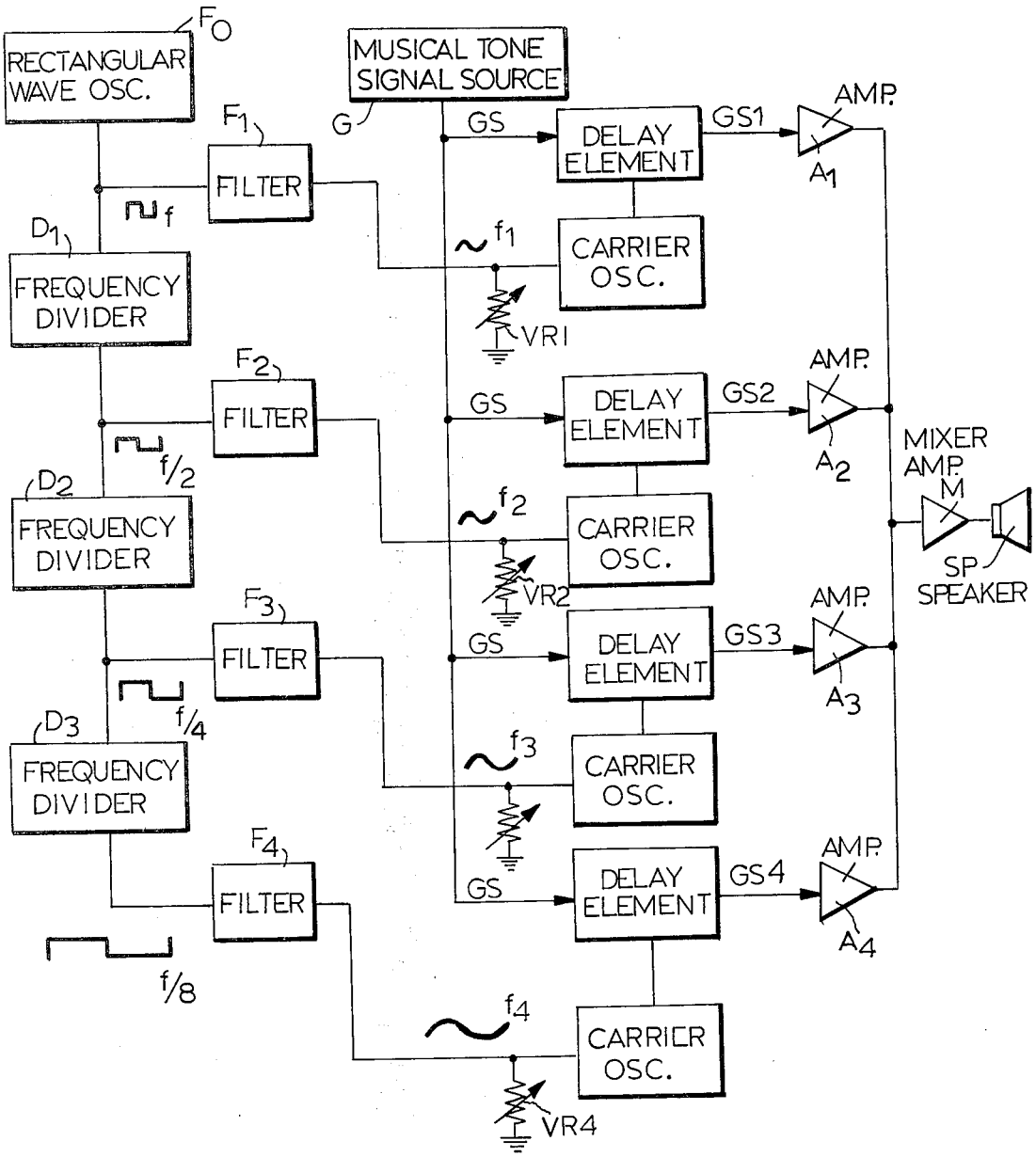
FIG. 1 is a schematic circuit diagram of an embodiment of this invention.
Figure 6:
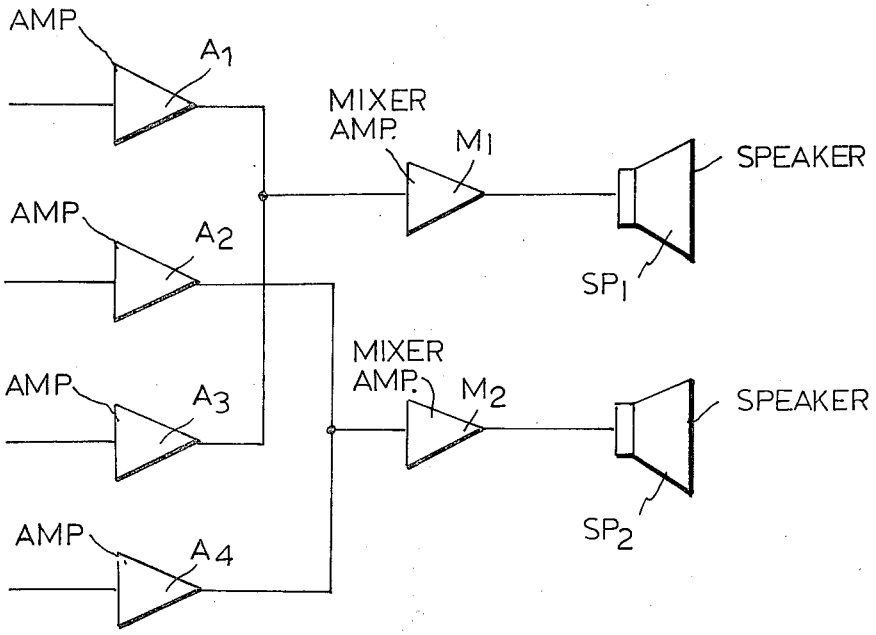
FIGS. 5 and 6 are partial schematic circuit diagrams of other examples of combinations of amplifiers, mixer amplifiers and speakers.
Figure 5:
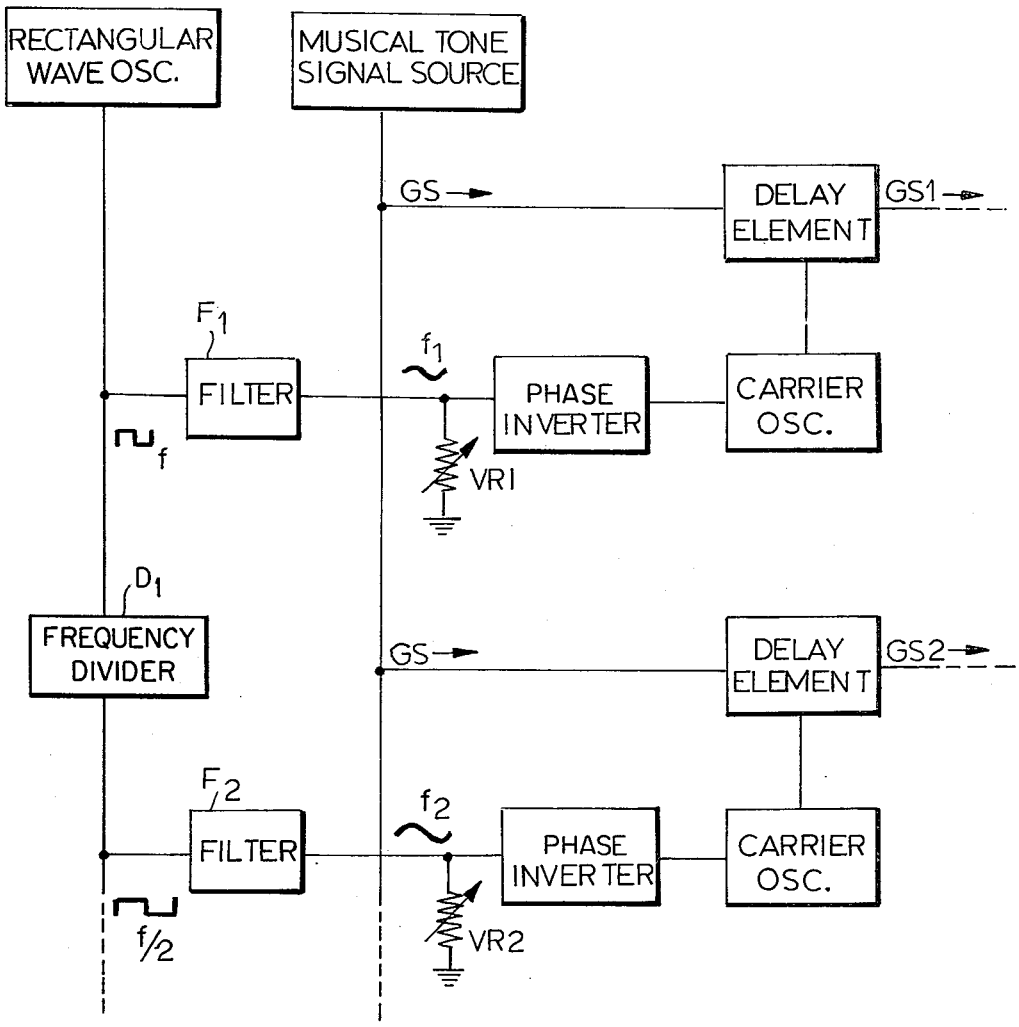

The depth of modulation of the individual signals can be varied by adjusting the level of the individual sinusoidal modulating waves f1, f2, f3 and f4. This is accomplished by providing variable resistors VR1, VR2, VR3 and VR4 connected between the connection between the filters and the variable oscillators and ground, as shown in FIG. 1. By this means, any desired level of ensemble effect can be attained. Further, an ensemble effect which is rich in variations can be achieved by adding a circuit for inverting the phases of the above described modulating waves f1, f2, f3 and f4 between the filters and the carrier oscillators, as shown in FIG. 5.

The circuit arrangement shown in FIG. 1 is a particular embodiment wherein there are four delay circuits and three stages of frequency divider circuits. The ensemble effect can be further promoted by using different means for electrically or acoustically mixing the musical tone signals, for example by increasing the number of said delay circuits and/or frequency divider circuits. One particular further embodiment has separate speakers SP1 and SP2 for acoustically reproducing the compound sounds, as shown in FIG. 5, wherein amplifiers A1 and A3 are connected to the mixer amplifier M1, and the amplifiers A2 and A4 are connected to the mixer amplifier M2. A much more complicated ensemble effect can be created by, for example, taking advantage of frequency divider circuits D1–D3 which divide the frequency f by $\frac{1}{3}$, 1/5, etc., or by like series of integral numbers, or by utilizing triangular waves in place of sinusoidal waves.

Thus it is seen that the device for producing an ensemble effect according to this invention is much better than those of the prior art, wherein the vibrato effect was not completely eliminated, because by the device of this invention, it has been adequately removed to produce a sufficiently satisfactory ensemble effect in the musical tone.

What is claimed is:

1. A device for producing an ensemble effect in an electronic musical instrument comprising a plurality of at least three parallel electronic delay circuits adapted to be supplied with the same musical tone signal; a plurality of delay time modulating means coupled to corresponding ones of said electronic delay circuits and each having a control input for modulating the delay time in said corresponding electronic delay circuit according to the signal applied to said control input; a modulating signal generating means coupled to said control inputs of each of said plurality of delay time modulating means for supplying a modulating signal of a single frequency to each of the control inputs of the respective delay time modulating means which has a different frequency from each of the other modulating signals and said different frequencies of the respective modulating signals being an integral fraction of the frequency of the highest frequency modulating signal; a plurality of amplifier means coupled to corresponding ones of said delay circuits for amplifying the output thereof; and mixing means coupled to said amplifier means for mixing the amplified outputs, whereby said integral fraction relationship of said modulating signals promotes cancellation of any vibrato effect thereby enhancing the ensemble effect.

2. A device as claimed in claim 1 in which said delay time modulating means each comprise a carrier oscillator circuit, and said modulating signal generating means comprises means for generating sinusoidal modulating signals.

3. A device as claimed in claim 1 in which said delay time modulating means each comprise a carrier oscillator circuit, and said modulating signal generating means comprises means for generating triangular wave shaped modulating signals.

4. A device as claimed in claim 1 in which said modulating signal generating means comprises a signal generator and a plurality of frequency dividers coupled thereto and the outputs of said signal generator and said frequency dividers being coupled to the respective delay time modulating means.

5. A device as claimed in claim 1 in which said modulating signal means further comprises a phase inverting means for inverting the phases of the respective modulating signals.

6. A device as claimed in claim 1 in which said modulating signal generating means further comprises modulating signal amplitude control means for controlling the amplitude of respective modulating signals, whereby the depth of delay time modulation of respective electronic delay circuits is varied.

* * * * *